US009803334B2

(12) United States Patent
Van der Neut et al.

(10) Patent No.: US 9,803,334 B2
(45) Date of Patent: Oct. 31, 2017

(54) DREDGING CUTTING WHEEL

(71) Applicant: IHC HOLLAND IE B.V., Sliedrecht (NL)

(72) Inventors: Cornelis Albert Van der Neut, Tholen (NL); Vincent Leonard Toet, Dordrecht (NL)

(73) Assignee: IHC Holland IE B.V., Sliedrecht (NL)

( * ) Notice: Subject to any disclaimer, the term of this patent is extended or adjusted under 35 U.S.C. 154(b) by 47 days.

(21) Appl. No.: 14/785,231

(22) PCT Filed: Apr. 16, 2014

(86) PCT No.: PCT/NL2014/050238
§ 371 (c)(1),
(2) Date: Oct. 16, 2015

(87) PCT Pub. No.: WO2014/171823
PCT Pub. Date: Oct. 23, 2014

(65) Prior Publication Data

US 2016/0145829 A1 May 26, 2016

(30) Foreign Application Priority Data

Apr. 16, 2013 (NL) ..... 2010645

(51) Int. Cl.
*E02F 3/92* (2006.01)
*E02F 3/24* (2006.01)
(Continued)

(52) U.S. Cl.
CPC ..... *E02F 3/9237* (2013.01); *E02F 3/241* (2013.01); *E02F 3/246* (2013.01); *E02F 3/8841* (2013.01); *E02F 3/905* (2013.01); *E02F 3/968* (2013.01)

(58) Field of Classification Search
CPC ..... E02F 3/92–3/9293; E02F 3/241; E02F 3/246; E02F 3/8841; E02F 3/905;
(Continued)

(56) References Cited

U.S. PATENT DOCUMENTS 349,381 A * 9/1886 Beard ..... E02F 3/9237 37/329
732,538 A * 6/1903 Fulcher ..... E02F 3/9237 37/332
(Continued)

FOREIGN PATENT DOCUMENTS

AU 625357 B2 7/1992
DE 4015340 A1 11/1990
(Continued)

OTHER PUBLICATIONS

International Search Report dated Jul. 14, 2014 for corresponding PCT Application No. PCT/NL2014/050238, 2 pages.

*Primary Examiner* — Robert Pezzuto
*Assistant Examiner* — Adam Behrens
(74) *Attorney, Agent, or Firm* — NLO N.V.; Catherine A. Shultz; Minerva Rivero

(57) ABSTRACT

Cutting wheel system (1) for a dredging device, comprising a cutting wheel (2) and a cutting wheel drive system (8), whereby the cutting wheel comprises at least two cutting element rings (3), which rings are positioned at a distance from each other in parallel planes whereby the cutting element rings have coaxial rotation axes (12,13), whereby a suction tube (7) can be positioned between the two cutting element rings (3), whereby the cutting wheel drive system is arranged to rotate the cutting wheel about the coaxial rotation axes, wherein the cutting wheel system further comprises connecting arms (9) for mounting the cutting wheel in a rotatable manner to the dredging device, wherein the connecting arms are moveable with respect to each other
(Continued)

between a closed position wherein the connecting arms engage the cutting wheel from opposite sides of the cutting wheel, and an open position wherein the cutting wheel is released from the connecting arms.

20 Claims, 4 Drawing Sheets

(51) Int. Cl.
*E02F 3/88* (2006.01)
*E02F 3/90* (2006.01)
*E02F 3/96* (2006.01)

(58) Field of Classification Search
CPC ..... E02F 3/968; E02F 3/01; E02F 3/18; E02F 3/783; E02F 5/08; E02F 5/109; E21C 25/08; E21C 25/16; E21C 25/18; E21C 27/24
See application file for complete search history.

(56) References Cited

U.S. PATENT DOCUMENTS 826,993 A * 7/1906 Coiseau ..... E02F 3/9237 37/329
1,731,838 A * 10/1929 Andersen ..... E02F 3/9212 37/318
1,777,575 A * 10/1930 Penney ..... E02F 3/9237 37/329
2,029,815 A * 2/1936 Rea ..... E02F 3/905 114/210
3,210,123 A * 10/1965 Delli-Gatti, Jr. ..... E21C 27/24 299/64
3,476,498 A * 11/1969 Von Bolhar ..... E02F 3/9237 209/250
3,614,837 A * 10/1971 Toshinobu ..... E02F 3/9237 37/189
3,777,376 A * 12/1973 Turner ..... E02F 3/9231 37/309
3,823,495 A * 7/1974 Robertson ..... E02F 3/9293 37/189
3,959,898 A * 6/1976 McWatters ..... E02F 3/905 188/268
4,052,801 A * 10/1977 Smith ..... E02F 3/9275 241/278.1
4,102,064 A * 7/1978 Pot ..... E02F 3/9231 37/310
4,212,121 A * 7/1980 Kato ..... E02F 3/88 37/195
4,242,814 A * 1/1981 Fluks ..... E02F 3/9237 37/189
4,259,795 A * 4/1981 Verboom ..... E02F 3/9237 37/329
4,267,652 A 5/1981 Senesac
4,395,833 A * 8/1983 Neumann ..... E02F 3/905 277/320
4,397,106 A * 8/1983 MdDowell ..... E02F 3/248 37/329
RE32,382 E * 3/1987 van den Elshout ... E02F 3/9237 37/189
4,646,449 A * 3/1987 Steinkuhler ..... E02F 3/9237 37/329
4,819,346 A * 4/1989 Maitlen ..... E02F 3/92 37/318
4,942,682 A * 7/1990 McDowell ..... E02F 3/181 37/189
5,071,183 A * 12/1991 McDermott ..... B66C 1/24 294/67.2
5,170,576 A * 12/1992 Steinkuhler ..... E02F 3/9237 37/329
5,192,116 A 3/1993 Turner et al.
5,791,074 A * 8/1998 Pryor ..... B63B 21/50 37/312
6,438,874 B1 * 8/2002 LaBounty ..... E02F 3/20 144/24.12
2015/0345107 A1 * 12/2015 Zwanenburg ..... E02F 3/9231 37/309

FOREIGN PATENT DOCUMENTS

| | | | |
|---|---|---|---|
| GB | 114915 | | 4/1918 |
| GB | 390267 | | 4/1933 |
| GB | 772470 | | 4/1957 |
| GB | 1207355 | A | 9/1970 |
| NL | 7903974 | | 11/1980 |
| NL | 8101842 | | 11/1982 |
| NL | 1009385 | C2 | 12/1999 |
| WO | 8300891 | | 3/1983 |
| WO | 2012102659 | A1 | 8/2012 |

* cited by examiner

DREDGING CUTTING WHEEL

FIELD OF THE INVENTION

The present invention relates to a cutting wheel system for a dredging device, in particular for a dredging vessel. The invention further relates to a method for operating a cutting wheel system.

BACKGROUND OF THE INVENTION

Cutting wheels are used in dredging to cut a relatively hard bottom of a water body before the bottom particles are transported to a dredging device or the like via a suction tube.

A cutting wheel is known from NL1009385, where the cutting wheel is driven by an engine that has drive elements at opposite sides of the cutting wheel. The cutting wheel comprises two rings of cutting elements, whereby the rings are each formed by several segmented parts of the ring, connected by an outer ring. The rings of cutting elements are connected to each other by an inner ring, such that they form the cutting wheel but remain at a distance of each other.

In case such a cutting wheel or the drive elements are damaged, the cutting wheel needs to be dismounted, which can only be done by taking apart the segments of the cutting wheel. This dismounting requires that the dredging period will be suspended for a considerable amount of time.

In addition, each segment of the cutting wheel needs to be manufactured separately and to be assembled before the cutting wheel can be used for dredging. This means that replacement of a cutting wheel is tedious work and costly.

It would therefore be desirable to provide an alternative cutting wheel system that alleviated at least some of the perceived inconveniences of the prior art.

BRIEF SUMMARY OF THE INVENTION

According to the invention there is provided a cutting wheel system for a dredging device, comprising a cutting wheel and a cutting wheel drive system, whereby the cutting wheel comprises at least two cutting element rings, which rings are positioned at a distance from each other in parallel planes whereby the cutting element rings have coaxial rotation axes, whereby a suction tube can be positioned between the two cutting element rings, whereby the cutting wheel drive system is arranged to rotate the cutting wheel about the coaxial rotation axes, wherein the cutting wheel system further comprises connecting arms for mounting the cutting wheel in a rotatable manner to the dredging device. The cutting wheel system further comprises connecting arms which are moveable with respect to each other between a closed position wherein the connecting arms engage the cutting wheel from opposite sides of the cutting wheel, and an open position wherein the cutting wheel is released from the connecting arms.

By using moveable connecting arms to connect with the cutting wheel, it is possible to move the connecting arms to a closed position wherein the connecting arms engage the cutting wheel, and to an open position in which at least one of the connecting arms is released from the cutting wheel, such that the cutting wheel can be removed from the cutting wheel system, without first taking apart the cutting wheel. In case both connecting arms are released from the cutting wheel, the cutting wheel is freely moveable in space.

In the closed position the arms are relatively close to each other, in the open position the arms are relatively remote from each other. In the closed position the arms engage the cutting wheel in a rotatable manner, i.e. allowing the cutting wheel to rotate.

This is advantageous in case the cutting wheel needs replacement or revision. Another advantage is that in case the cutting wheel drive system needs revision or repair, the cutting wheel can easily be removed to gain access to the cutting wheel drive system.

In addition, the cutting wheel can either be assembled together before mounting in the cutting wheel system, either by bolting or by welding the parts together, or be manufactured as a single unit, i.e. in one piece, that does not need to be assembled afterwards. This saves time such that the dredging process can be resumed without too much delay, and thus saves costs.

According to an embodiment, the distance between the cutting element rings is such that at least an end part of the suction tube is positionable between the cutting element rings.

The cutting wheel cuts the bottom of the water body such that the cut bottom parts can be dredged by the dredging device. To allow the dredging device to take in the cut bottom parts, at least a part of a suction tube is provided at the cutting wheel. To allow the end part of the suction tube to be arranged between the cutting element rings, the distance between the cutting element rings is such that an end part of the suction tube can be positioned between the cutting element rings. The end part of the suction tube between the cutting element rings can be a mouthpiece of the suction tube having a smaller diameter than the suction tube itself. The shape of the suction tube and the mouthpiece can be different, such as a cylindrical suction tube, having a diameter, with a rectangular mouth piece, having a width dimension. The part of the suction tube that is to be positioned in between the cutting element rings has a largest dimension parallel to the rotational axis of the wheel, which largest dimension is smaller than a minimal distance between the cutting element rings parallel to the rotation axis.

By positioning the end part of the suction tube between the cutting element rings, transportation of the cut material from the bottom to the suction tube is facilitated by the rotation of the cutting wheel.

According to a further embodiment, the cutting wheel comprises a retaining device which is arranged to keep the cutting wheel in place when the connecting arms are in the open position. Furthermore, the cutting wheel may comprise a connecting element which is arranged to connect the cutting wheel to the retaining device to support the cutting wheel when the connecting arms are in the open position.

By releasing the cutting wheel, it is freely moveable in space. An additional connecting element is provided at the cutting wheel to be able to connect the cutting wheel to a retaining device, such as a hoisting crane or a supporting vessel. This retaining device will prevent the cutting wheel to move away from the dredging device, or even fall to the bottom of the water body. In addition, the retaining device can be used to move the cutting wheel such that it can either be repaired or revised above water or being replaced by a new cutting wheel. The connecting element may be a ring or hook which can receive a hook from a hoisting system, e.g. a crane. Alternatively, the connecting element can be an opening provided in the cutting wheel, through which opening a hoisting cable or the like can be inserted and connected.

According to an embodiment the cutting wheel drive system comprises a drive element provided at at least one of the connecting arms, wherein, in the closed position of the connecting arms, the drive element is arranged to rotate the cutting wheel.

Instead of one drive element, two drive elements may be provided, each connecting arm comprising one drive element.

In the closed position, the drive elements are connected to the cutting element rings, such that the drive elements can rotate the cutting wheel about the coaxial rotation axes and cut the bottom of the water body for dredging. The drive elements can be connected to the connecting arms, such that when the connecting arms are in the open position, the cutting wheel can be released from both the connecting arms and the drive elements. The cutting wheel can then be easily dismounted.

In order to allow the connecting arms to be moveable with respect to each other, one or both of the connecting arms can be moveably connected to the supporting structure of the dredging device. An example of such a moveable connection is a hinge, such that at least one of the connecting arms can be rotated along the hinge axis from the closed to the open position and vice versa. In case more than one connecting arm has a moveable connection, each of these arms is connected to the supporting structure by a hinge, respectively. The hinge axis may be substantially perpendicular to the rotational axis of the cutting wheel. The hinge axis or hinge axes may have a substantially vertical orientation.

Another example is an arrangement to move one or both of the connecting arms linearly, i.e. in a linear direction, for example parallel to the coaxial rotation axis of the cutting wheel, for instance by means of hydraulics or by sliding, from the closed to the open position and vice versa. In case both of the connecting arms are moved, the linear movement can be in opposite directions, for example parallel to the coaxial rotation axis of the cutting wheel. A combination of a rotation and a linear movement is possible as well.

Preferably, the supporting structure comprises a ladder of a dredging vessel. The supporting structure is part of the dredging device. When the dredging device is a dredging vessel, the supporting structure can be the ladder of the dredging vessel to which the moveable connecting arms are connected.

According to an embodiment, the suction tube comprises a first part extending between the supporting structure and the cutting wheel and a second part extending in a downward direction from the first part between the cutting element rings. Preferably, the central axis of the first part of the suction tube and the coaxial axes of the cutting element rings lie in the same plane, such that the second part extends to below the coaxial axes. Preferably, the cutting wheel rotates in a direction towards the second part of the suction tube. The cut bottom parts are then transported towards a mouth of the suction tube.

The invention also relates to a dredging vessel comprising a cutting wheel system according to the above.

According to an embodiment, the dredging vessel comprises a retaining device for keeping the cutting wheel between the connecting arms when the connecting arms are in the open position. Alternatively, the retaining device is provided on a further vessel or at shore nearby the dredging vessel.

Additionally, the invention relates to a method for replacing or revising a cutting wheel from a cutting wheel system, comprising connecting arms engaging the cutting wheel from opposite sides of the cutting wheel in a rotatable manner and being moveable with respect to each other, the method comprising:

moving the connecting arms to an open position such that the cutting wheel is released, retaining the cutting wheel in between the connecting arms by means of a retaining device.

For easy replacement of the cutting wheel in the cutting wheel system, the use of a cutting wheel that is either pre-assembled or manufactured as one piece, i.e. a single unit, is advantageous, as this saves time during the dredging process. The cutting element rings can thus be integrally formed as the cutting wheel or can be fixedly connected after manufacture to form the cutting wheel. Such a cutting wheel can be mounted in a cutting wheel system with connecting arms that are moveable with respect to each other between an open and a closed position. For this one arm or both arms can be moved between an open and a closed position. Using the connecting arms that are moveable with respect to each other, has the advantage of an easy dismount of the cutting wheel. The connecting arms can be moved to an open position to release the cutting wheel, which can then be dismounted from the cutting wheel system.

Preferably, the method comprises before moving the connecting arms to the open position, connecting the cutting wheel to a retaining device by a connection element provided on the cutting wheel, to retain the cutting wheel in the open position of the connecting arms. The retaining device may be a hoisting element extending from the dredging device to the cutting wheel to hoist from or to keep the cutting wheel between the connecting arms in the open position. Alternatively or additionally, a supporting vessel may be provided to support the cutting wheel in the open position of the connecting arms. Furthermore, the supporting vessel can be provided with the retaining device.

By releasing the cutting wheel when moving the connecting arms in the open position, the cutting wheel is freely moveable in space. A retaining device to retain the cutting wheel in the open position of the connecting arms, will prevent the cutting wheel to move away from the dredging device, or even fall to the bottom of the water body. In addition, the retaining device in the form of a hoisting element, such as a hoisting crane, can be used to hoist the cutting wheel such that it can either be repaired or revised above water or being replaced by a new cutting wheel.

Furthermore, before moving the connecting arms to the open position, the cutting wheel can be connected to the retaining device by a connecting element provided on the cutting wheel. The connecting element may be an opening in the cutting wheel extending from one cutting element ring to the other such that a hoisting cable or the like can be inserted in the opening to hoist the cutting wheel. The connecting element may be a hook or an eye connected to one or both of the cutting element rings to connect a hoisting cable to the cutting wheel.

According to an embodiment, the method comprises:

positioning a revised or replacement cutting wheel between connecting arms being at opposite sides of the revised or replacement cutting wheel, moving the connecting arms to a closed position such that the connecting arms rotatably engage the revised or replacement cutting wheel at opposite sides.

The cutting wheel can be revised or replaced. After mounting a revised or replacement cutting wheel in the cutting wheel system, the connecting arms are moved to a closed position and engage the cutting wheel at the outer sides of the cutting element rings facing away from each other.

Preferably, the cutting wheel system is mounted to a ladder of a dredging vessel, and the method comprises before moving the connecting arms to an open position; positioning the ladder in a top position such that the cutting wheel is above water.

BRIEF DESCRIPTION OF THE DRAWINGS

The features and advantages of the invention will be appreciated upon reference to the following drawings of a number of exemplary embodiments, in which.

DESCRIPTION OF ILLUSTRATIVE EMBODIMENTS

Figure 1:
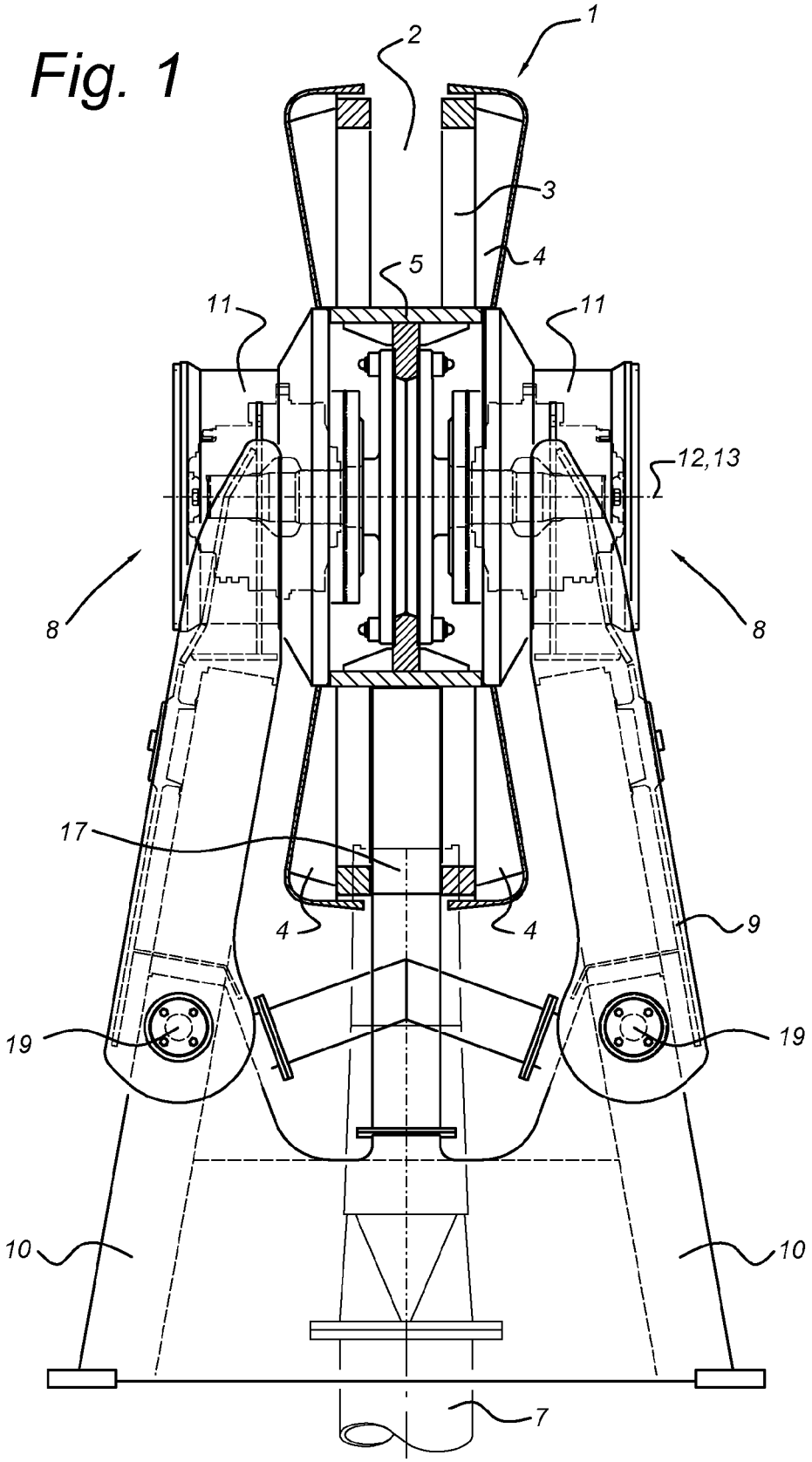
FIG. 1 shows a top view of a cutting wheel system with connecting arms in a closed position.

FIG. 1 shows a top view of a cutting wheel system 1 with connecting arms 9 in a closed position. The cutting wheel system 1 includes a cutting wheel 2 and a cutting wheel drive system 8 to rotate the cutting wheel around a rotation axis 12. The cutting wheel drive system 8 comprises two connecting arms 9 connecting the cutting wheel 2 to a ladder 10 of a dredging vessel 20 (see FIG. 4).

The cutting wheel 2 is built from two cutting element rings 3 that are connected to each other by an inner connection ring 5 to form the cutting wheel 2. The connection ring 5 connects the cutting element rings 3 at an inner side of the cutting element rings 3, such that at an outer side of the cutting wheel an opening 6 is left between the cutting element rings 3 and the space between the cutting element rings 3 is accessible. The opening 6 is provided along the circumference of the cutting wheel.

The cutting element rings 3 have coaxial axes 13 and are at a distance from each other in parallel planes. The two cutting element rings 3 are both provided with cutting elements 4 positioned along the circumference of the rings 3. The connecting arms 9 engage the cutting wheel at the location of the connection ring 5. Drive elements 11 are provided at the connecting arms and each have a rotation axis 12 that is coaxial with the axis 13 of the cutting wheel 2 in the closed position of the connecting arms. The drive elements 11 rotate the cutting wheel around the axes 12, 13 such that the cutting elements 4 in use will cut away the bottom of the water body.

The connection arms 9 are hingeably connected to the ladder 10 of a dredging vessel 20 by means of hinges 19. Each connection arm 9 can be moved independently of the other connection arm 9. In addition, each connection arm 9 is provided with a drive element 11 for rotating the cutting wheel 2 in the closed position of FIG. 1.

The distance between the cutting element rings 3 corresponds to the typical dimensions of the suction tube 7 extending from the dredging vessel 20. The suction tube 7 has a mouth piece 17 that is positioned between the cutting element rings 3. The opening 6 is formed such that a mouth piece of a suction tube 7 can be inserted between the cutting element rings 3.

Figure 2:
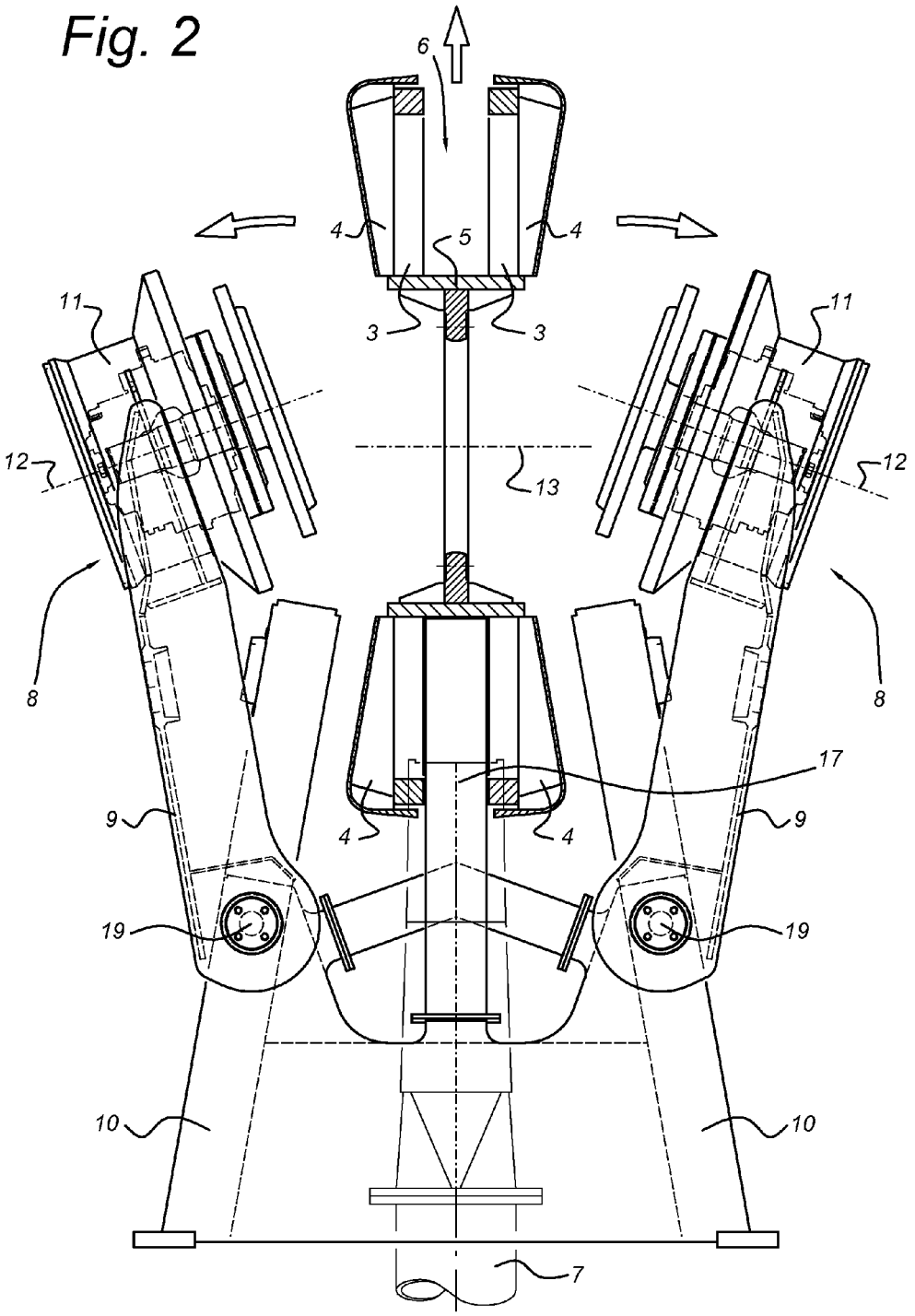
FIG. 2 shows a top view of a cutting wheel system with connecting arms in an open position.

FIG. 2 shows a top view of a cutting wheel system 1 with connecting arms 9 in an open position. The connecting arms 9 are each hinged about a hinge axis 15 to the open position to release the cutting wheel 2. The cutting wheel 2 is now easily accessible for either repair or revision on site or for replacement. The hinges 19 are operated to position the connecting arms 9 in an open to a closed position and vice versa by an actuator, such as an hydraulic system or a motor.

Figure 3:
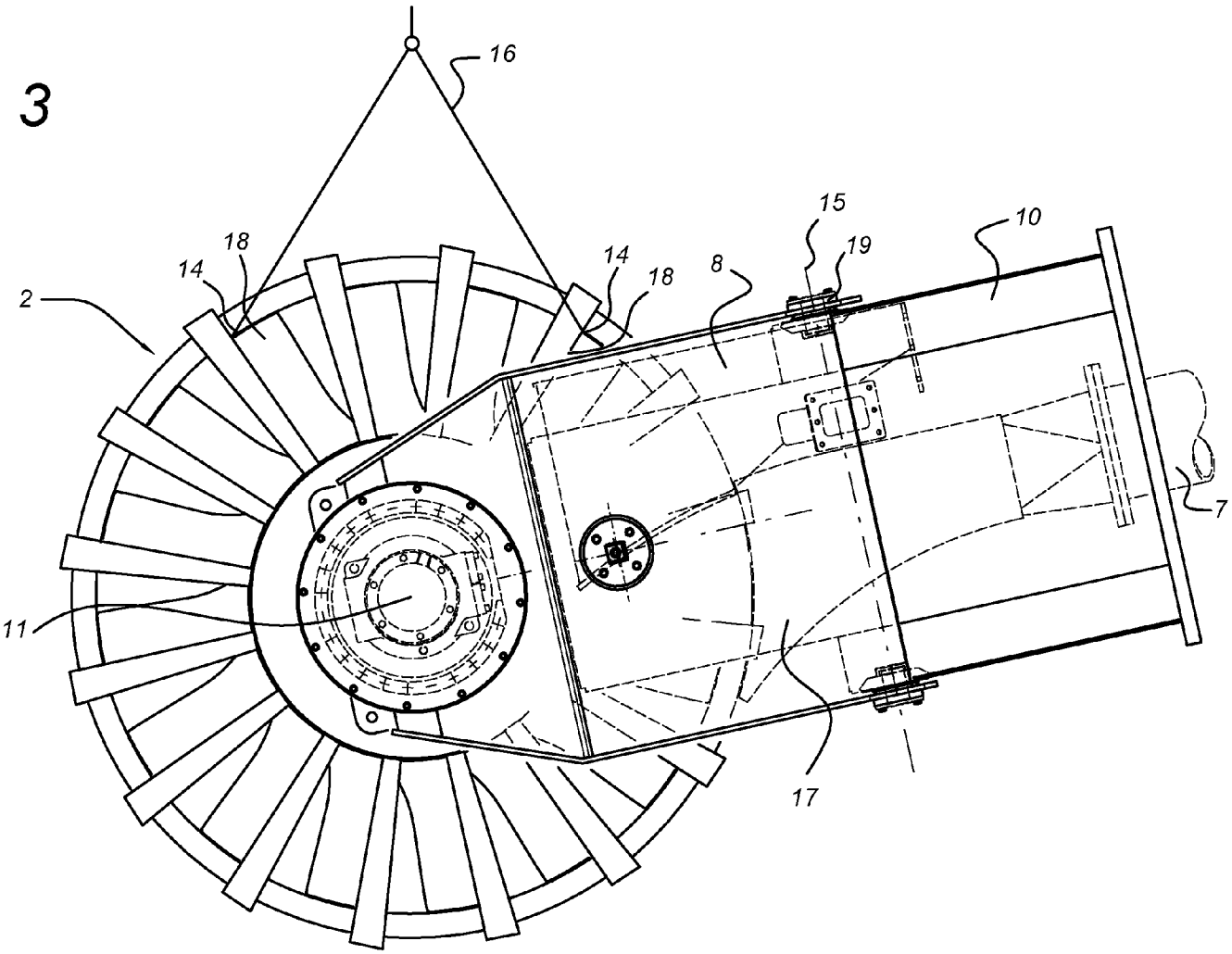
FIG. 3 shows a side view of a cutting wheel system.

FIG. 3 shows a side view of a cutting wheel system 1 in the closed position. The cutting wheel drive system 8 engages the cutting wheel 2. The connection arms 9 are rotated around hinge axes 15 to the closed position. The suction tube 7 extends from the dredging vessel 20 (see FIG. 4) to the cutting wheel system. The mouth piece 17 of the suction tube 7 is situated between the cutting elements 4 of the cutting element rings 3. Before rotating each of the connection arms 9 around a hinge axis 15 to the open position and releasing the cutting wheel, the cutting wheel is connected to the dredging vessel through a retaining device, such as a (hoisting) crane 16. The hoisting crane 16 is connected to the cutting wheel 2 by hoisting cable 14. FIG. 3 shows the connection of the hoisting crane 16 by inserting the hoisting cable 14 through openings 18 in the cutting wheel 2. The openings 18 extend from one cutting element ring 3 to another.

Figure 4:
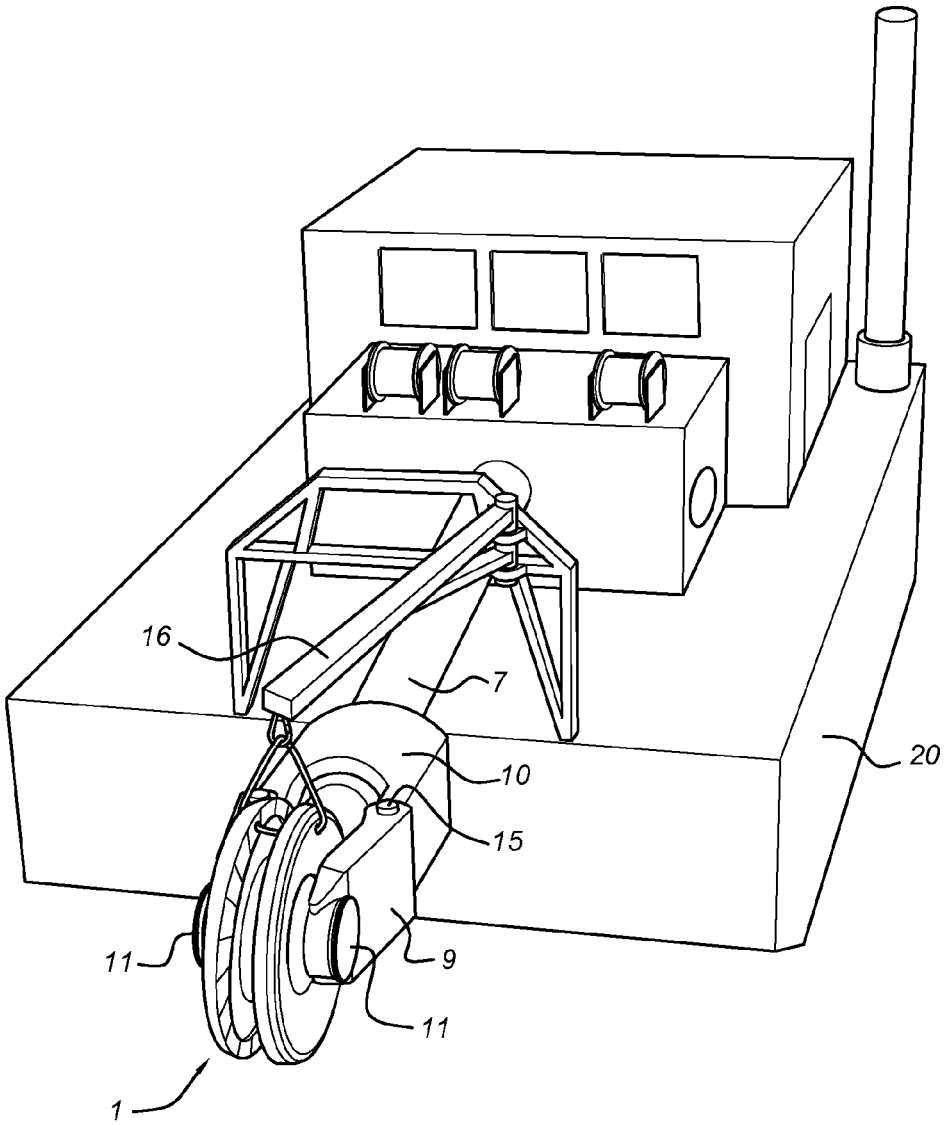
FIG. 4 shows a dredging vessel provided with a cutting wheel system as in FIGS. 1-3.

FIG. 4 shows a dredging vessel 20 provided with a cutting wheel system 1 as described above. The dredging vessel 20 is provided with a ladder 10 to which the cutting wheel drive system 8 is connected. The connecting arms 9 of the cutting wheel drive system 8 are in an open position initially (not shown). Additionally, the dredging vessel 20 is provided with a hoisting crane 16. The cutting wheel 2 is provided with openings 18 (see FIG. 3) to which the hoisting cable 14 of the hoisting crane 16 is connected. The cutting wheel 2 is hoisted between the connecting arms 9, the connecting arms 9 being at opposite sides of the cutting wheel 2. The connecting arms 9 are then rotated about hinging axes 15 to a closed position, such that the connecting arms 9 engage the cutting wheel 2 at opposite sides. After mounting the cutting wheel 2 between the connecting arms 9, the hoisting cable 14 of the crane 16 is released.

LIST OF PARTS

1. Cutting wheel system
2. Cutting wheel
3. Cutting element ring
4. Cutting element
5. Connection ring
6. Opening
7. Suction tube
8. Cutting wheel drive system
9. Connecting arm
10. Ladder
11. Drive element
12. Rotation axis
13. Coaxial axes
14. Connecting element
15. Hinging axis
16. Hoisting crane/retaining device
17. Mouth piece
18. Connecting element
19. Hinge
20. Dredging vessel

The invention claimed is:

1. A cutting wheel system for a dredging device, comprising a cutting wheel and a cutting wheel drive system, whereby the cutting wheel comprises at least two cutting element rings, which rings are positioned at a distance from each other in parallel planes, are joined by a connection ring at an inner side, and have coaxial rotation axes, whereby a suction tube can be positioned between the two cutting element rings, whereby the cutting wheel drive system is arranged to rotate the cutting wheel about the coaxial rotation axes, wherein the cutting wheel system further comprises connecting arms for mounting the cutting wheel in a rotatable manner to the dredging device, and wherein the connecting arms are moveable with respect to each other between a closed position wherein the connecting arms engage the cutting wheel from opposite sides of the cutting wheel, and an open position wherein the cutting wheel is released from the connecting arms.

2. The cutting wheel system according to claim 1, comprising a retaining device which is arranged to keep the cutting wheel in place when the connecting arms are in the open position.

3. The cutting wheel system according to claim 2, wherein the cutting wheel comprises a connecting element which is arranged to connect the cutting wheel to the retaining device to retain the cutting wheel when the connecting arms are in the open position.

4. The cutting wheel system according to claim 1, wherein the distance between the cutting element rings is such that at least an end part of a suction tube is positionable between the cutting element rings.

5. The cutting wheel system according to claim 1, wherein the cutting wheel drive system comprises a drive element provided at at least one of the connecting arms, wherein, in the closed position of the connecting arms, the drive element is arranged to rotate the cutting wheel.

6. The cutting wheel system according to claim 1, wherein at least one of the connecting arms is moveably connected to a supporting structure of a dredging device to move the connecting arms with respect to each other between the closed position and the open position.

7. The cutting wheel system according to claim 6, whereby the at least one connecting arm is hingeably connected by a hinge to a supporting structure to rotate the connecting arms with respect to each other along a hinge axis of the hinge between the closed position and the open position.

8. The cutting wheel system according to claim 6, wherein the supporting structure comprises a ladder of a dredging vessel.

9. The cutting wheel system according to claim 1, wherein the cutting wheel is a single unit.

10. A dredging vessel comprising: a cutting wheel system, the cutting wheel system comprising: a cutting wheel comprising at least two cutting element rings positioned at a distance from each other in parallel planes whereby the cutting element rings have coaxial rotation axes and are joined by a connection ring at an inner side;

a cutting wheel drive system arranged to rotate the cutting wheel about the coaxial rotation axes;

connecting arms moveable with respect to each other between a closed position engaging the cutting wheel from opposite sides and an open position to release the cutting wheel, and a retaining device connected to the dredger for retaining the cutting wheel with respect to the dredger when the connecting arms are in the open position and the cutting wheel is released.

11. The dredging vessel according to claim 10, and further comprising a suction tube positioned between the two cutting element rings.

12. The dredging vessel according to claim 11, wherein the suction tube comprises a first part extending between a supporting structure and the cutting wheel and a second part extending in a downward direction from the first part between the cutting element rings.

13. The dredging vessel according to claim 11, wherein a central axis of the first part of the suction tube and the coaxial axes of the cutting wheels lie in the same plane and wherein the second part extends from the first part between the cutting element rings such the second part is below the plane of the central axis and the axial axis.

14. The dredging vessel according to claim 10, wherein in use the cutting wheel rotates in a direction towards an opening of an end part of the suction tube.

15. A method for replacing or revising a cutting wheel from a cutting wheel system for a dredging device comprising connecting arms engaging the cutting wheel from opposite sides of the cutting wheel in a rotatable manner and being moveable with respect to each other, the method comprising: moving the connecting arms to an open position by rotating each connecting arm such that the cutting wheel is released, and retaining the cutting wheel in between the connecting arms by means of a retaining device.

16. The method according to claim 15, comprising moving the cutting wheel away from the connecting arms.

17. The method according to claim 15, comprising: positioning a revised or replacement cutting wheel between connecting arms being at opposite sides of the revised or replacement cutting wheel, moving the connecting arms to a closed position such that the connecting arms rotatably engage the revised or replacement cutting wheel at opposite sides.

18. The method according to claim 15, whereby the cutting wheel comprises at least two cutting element rings, which rings are positioned at a distance from each other in parallel planes, are joined by a connection ring at an inner side, and have coaxial rotation axes, between which rings a suction tube of a dredging device is positionable.

19. The method according to claim 15, comprising connecting the cutting wheel to the retaining device.

20. The method according to claim 15, and further comprising positioning a ladder of a dredging vessel in a top position such that the cutting wheel is above water.

* * * * *